United States Patent [19]

Walton

[11] Patent Number: 4,471,597

[45] Date of Patent: Sep. 18, 1984

[54] EXTRUDED PLASTIC WINDOW FRAMING

[76] Inventor: Michael A. Walton, 7993 Huron River Dr., Dexter, Mich. 48130

[21] Appl. No.: 288,908

[22] Filed: Jul. 31, 1981

[51] Int. Cl.[3] ..... E04C 2/34

[52] U.S. Cl. ..... 52/775; 52/764

[58] Field of Search ..... 52/775; 49/504; 22/764, 22/765

[56] References Cited

U.S. PATENT DOCUMENTS

| | | | |
|---|---|---|---|
| 3,432,966 | 3/1969 | Bordner | 49/483 X |
| 3,455,080 | 7/1969 | Meadows | 52/775 X |
| 3,492,770 | 2/1970 | Furner | 52/400 |
| 3,668,830 | 6/1972 | Frank et al. | 52/775 X |
| 3,703,063 | 11/1972 | Budich et al. | 49/504 X |
| 3,750,358 | 8/1973 | Lewkowitz | 52/764 X |
| 3,758,997 | 9/1973 | Vance | 49/504 X |
| 3,868,789 | 3/1975 | Gates | 49/501 |
| 3,918,231 | 11/1975 | Kessler | 52/628 |
| 4,110,942 | 9/1978 | Slocomb, Jr. | 52/100 |
| 4,189,520 | 2/1980 | Gauchel | 428/520 |

FOREIGN PATENT DOCUMENTS

| | | | |
|---|---|---|---|
| 1180922 | 11/1964 | Fed. Rep. of Germany | 52/775 |
| 2321974 | 11/1974 | Fed. Rep. of Germany | 52/775 |
| 706698 | 5/1966 | Italy | 52/775 |

*Primary Examiner*—Kenneth Downey
*Attorney, Agent, or Firm*—James M. Deimen

[57] ABSTRACT

A plastic window framing for single or double glazing and single or multiple panes. The frames comprise mullions, glass stops, nailing fins and expansion strips extruded from modified polyolefins that are weather and ultraviolet degradation resistant. The glass stops and expansion strips are co-extruded integral combinations of a hard rigid plastic support and a very flexible sealing portion. Since both the hard rigid portion and the flexible sealing portion of the extrusions are of the same weather and ultraviolet resistant plastic, the plasticizer being the addition for flexibility, the entire framing including the seals can be exposed to the external environment and the mullions can be of relatively simple configuration.

The mullions are symmetrical about perpendicular planes longitudinal with the extrusion. The mullions of identical cross-section can be used for vertical and horizontal members of the frame including intermediate mullions between panes. Interior and exterior glass stops are identical in cross-section and can be interchanged and used for both single and double glazing without alteration of the glass stops or mullions.

10 Claims, 5 Drawing Figures

EXTRUDED PLASTIC WINDOW FRAMING

BACKGROUND OF THE INVENTION

The invention pertains to the field of window framing for commercial, industrial and residential windows and, in particular, to extruded frames for single or multiple glazed windows.

For many years window frames constructed of extruded aluminum have been widely available for commercial and residential buildings. Such frames are weather resistant for extended periods of time. In particular, they are resistant to moisture, heat and solar ultraviolet degradation. The aluminum framing, however, is highly heat conductive and severly degraded and corroded by salt mist at seashore locations. To reduce the thermal conductivity of aluminum framing, modern framing incorporates vinyl plastic breaks between inside and outside portions of the frame. To reduce the salt mist corrosion, modern aluminum framing incorporates a hard anodized surface treatment or a salt and weather resistant surface coating such as plastic or paint.

With the exception of marine window frames such as that disclosed in U.S. Pat. No. 3,868,789, window frames constructed of extruded plastic have not become generally available in the market place. U.S. Pat. No. 4,110,942 illustrates a polyvinyl chloride extruded window frame mullion with appendages that may be selectively trimmed depending on the position of the frame member in the window.

Until recently most plastics suitable for extrusion as window frames have been severely degraded by ultraviolet radiation or otherwise structurally inadequate for window frames. Plastic materials that are resistant to ultraviolet degradation have been unsuitable for extrusion or otherwise unsuitable as the structural component of the window frame.

To overcome the above limitations various composite constructions have been proposed. U.S. Pat. No. 3,492,770 illustrates an aluminum frame covered by interlocking dovetailed plastic pieces. Such a construction, however, is unduly complicated. U.S. Pat. No. 3,918,231 illustrates a less complicated means for attaching a plastic cover piece to a metal window frame. U.S. Pat. No. 4,189,520 illustrates window or door structural framing of polyvinyl chloride coated with polymethylmethacrylate to improve the weatherability and ultraviolet resistance of the framing.

SUMMARY OF THE INVENTION

The advent of much improved modified polyolefin plastics in a variety of extrustion grades makes possible extruded plastic window framing that is weather and ultraviolet degradation resistant for an indefinite number of years.

Applicant's window frames comprise mullions with separate glass stops, nail fins and expansion strips all extruded from plastic in shapes that permit installation of single or double glazing and single or multiple panes. Identical mullions, glass stops, nailing fins and expansion strips are used for single or double glazing. The glass stops and expansion strips comprise co-extrusions of a rigid plastic and a flexible plastic to form a rigid member with a flexible sealing portion integral therewith. With the exception of junctures between the mullions, no fasteners are required, the glass stops, nailing fins and expansion strips being formed to snap into sockets formed in the mullions.

Since both the hard rigid portions and the flexible sealing portions of the extrusions are of the same weather and ultraviolet resistant plasitc, the plasticizer being the addition for flexibility, the entire framing including the seals can be exposed to the external environment and the mullions can be of relatively simple construction.

DESCRIPTION OF THE PREFERRED EMBODIMENT

Figure 1:
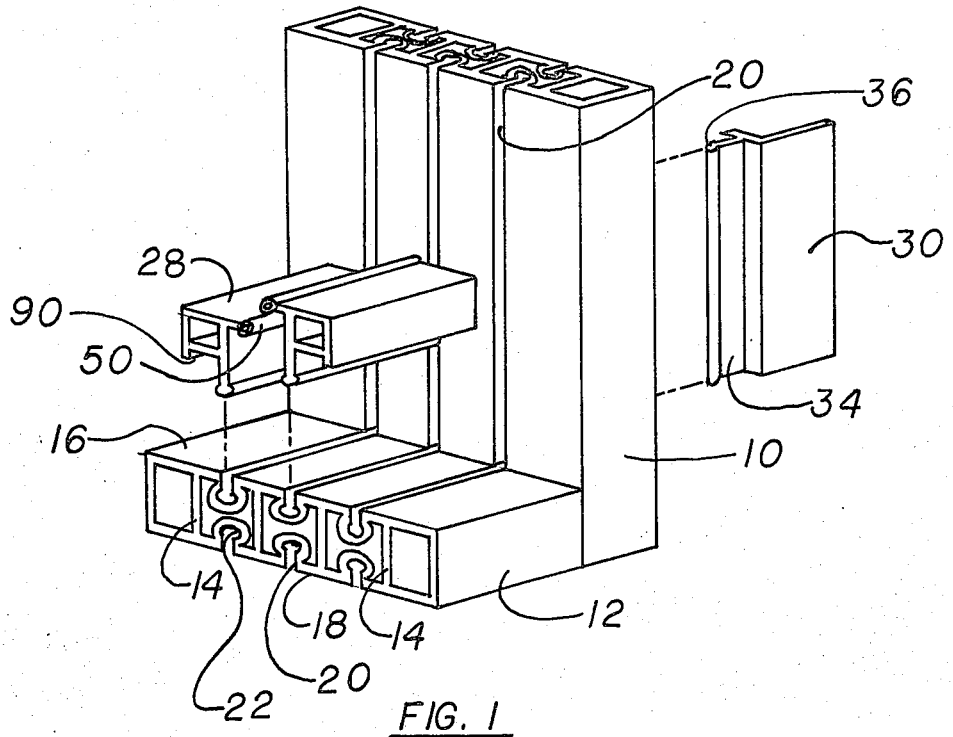
FIG. 1 is an exploded perspective view of a portion of the plastic window frame construction.

Illustrated in FIG. 1 are two extruded window frame members or mullions 10 and 12 joined at a corner to form a portion of a window frame. The mullions 10 and 12 are identical in cross-section with a plurality of internal dividers 14 dividing the hollow mullion interior longitudinally. The sides 16 and 18 of the mullions have longitudinal channels 20 formed therein. The channels 20 are formed with a bulbous socket 22.

Figure 2:
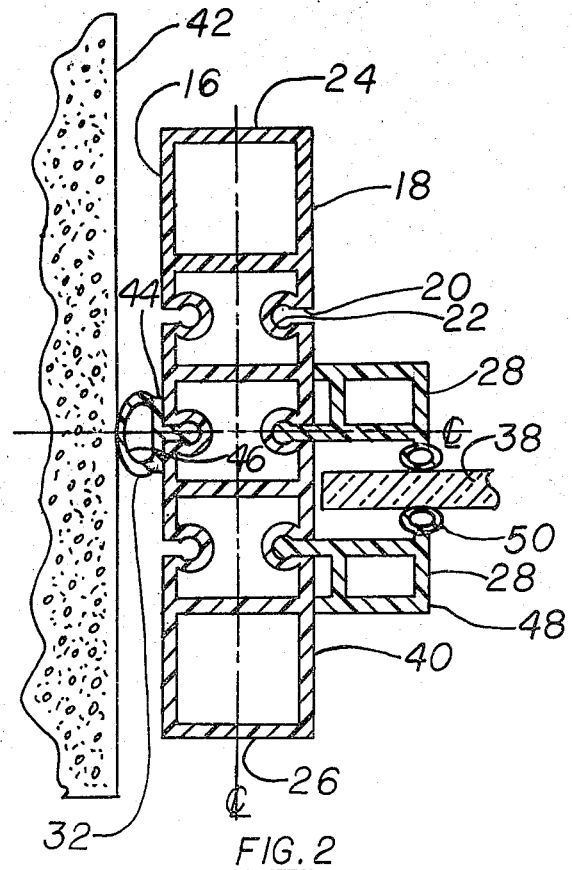
FIG. 2 is a cross-sectional view of a portion of the window framing assembled for single glazing.
Figure 3:
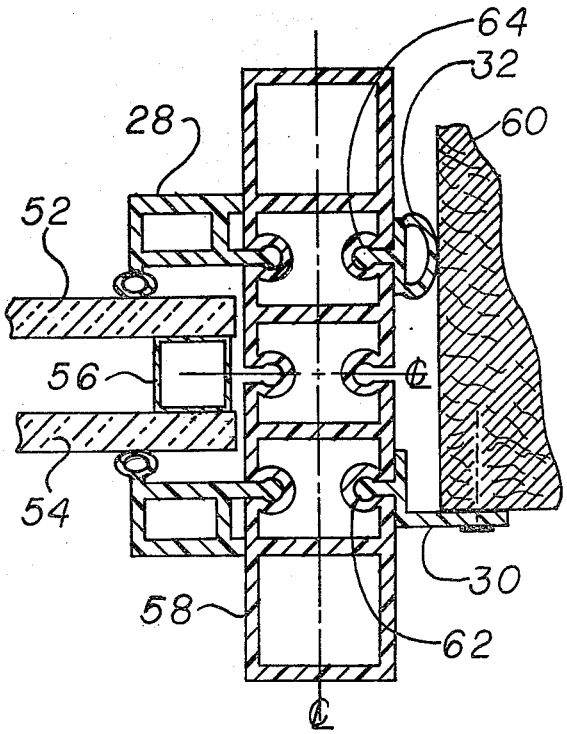
FIG. 3 is a cross-sectional view of a portion of the window framing assembled for double glazing.

As illustrated in FIGS. 2 and 3, the mullions are symmetric in cross-section about central longitudinal perpendicular planes through the sides and through the edges 24 and 26 of the mullions.

The channels 20 are sized to retain various extruded attachments such as the glass stops 28, nail fins 30 and expansion strips 32. The attachments include longitudinal protrusions 34 having bulbous ends 36 complementary to the channels 20 and sockets 22. Thus, any of the attachments may be snapped into any of the channels 20 in the mullions.

FIGS. 2 and 3 illustrate typical window frame configurations adjacent masonry and wood construction respectively. In FIG. 2 an expansion strip 32 separates the mullion 40 from the masonry 42 to form a seal therewith. The expansion strip 32 comprises a rigid portion 44 and a hollow flexible portion 46 co-extruded therewith to sealingly engage the masonry 42.

On the opposite side of the mullion 40 in FIG. 2 are a pair of identical opposed glass stops 28 in engagement with a single pane 38 of glass or other glazing. The glass stops comprise a rigid portion 48 and a flexible portion 50 co-extruded therewith. The flexible portion 50 forms a weathertight seal with the glass.

In FIG. 3 the glass stops 28 engage two separate panes of glass 52 and 54 in turn separated by an extruded spacer 56. As is apparent, the same mullions and glass stops can be used for either single or double glazing. The mullion 58 in FIG. 3 is adjacent wood construction 60. A nailing fin 30 is fastened to the wood 60 and snapped into the mullion 58 as shown at 62. An expansion strip 32 also is snapped into the mullion 58 at 64 to sealingly engage the wood 60.

The mullions, expansion strips, nailing fins and glass stops are preferably extruded from modified polyolefin plastics such as those available from International Polymers, Inc., Grand Prairie, Tex. The mullions and nailing fins are preferably extruded from REN 2402 grade which is a very rigid form of weather and ultraviolet resistant plastic. The glass stops and expansion strips are coextruded of 2402 grade for the rigid portions thereof and REN 1016 grade which contains sufficient plasticizer to provide a very flexible seal for the sealing portions. The co-extrusion provides a seamless integral structure that is weather and ultraviolet resistant and can therefore be directly exposed to the environment.

Figure 4:
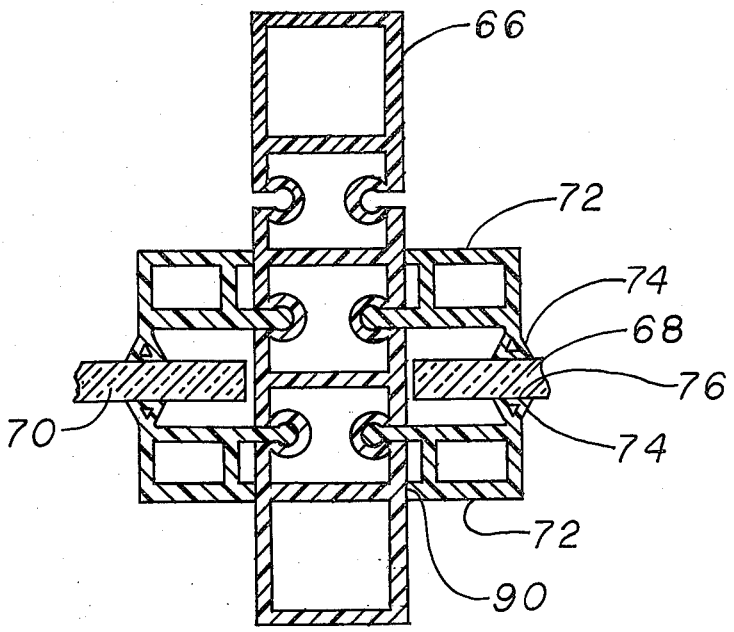
FIG. 4 is a cross-sectional view of a portion of the window framing assembled for multiple panes; and, FIG. 5 is a partial side view of the window framing illustrated mullion fastening means.

FIG. 4 illustrates in cross-section a mullion 66 intermediate between two panes 68 and 70 of single pane glazing. Although the mullion 66 is identical to the mullions above, the glass stops 72 are modified. The co-extruded flexible portion 74 is substantially triangular in cross-section rather than circular as in FIGS. 1 through 3. The triangular cross-section provides a broader engagement surface at 76 without the tendency to trap dirt and moisture of the circular cross-section.

Figure 5:
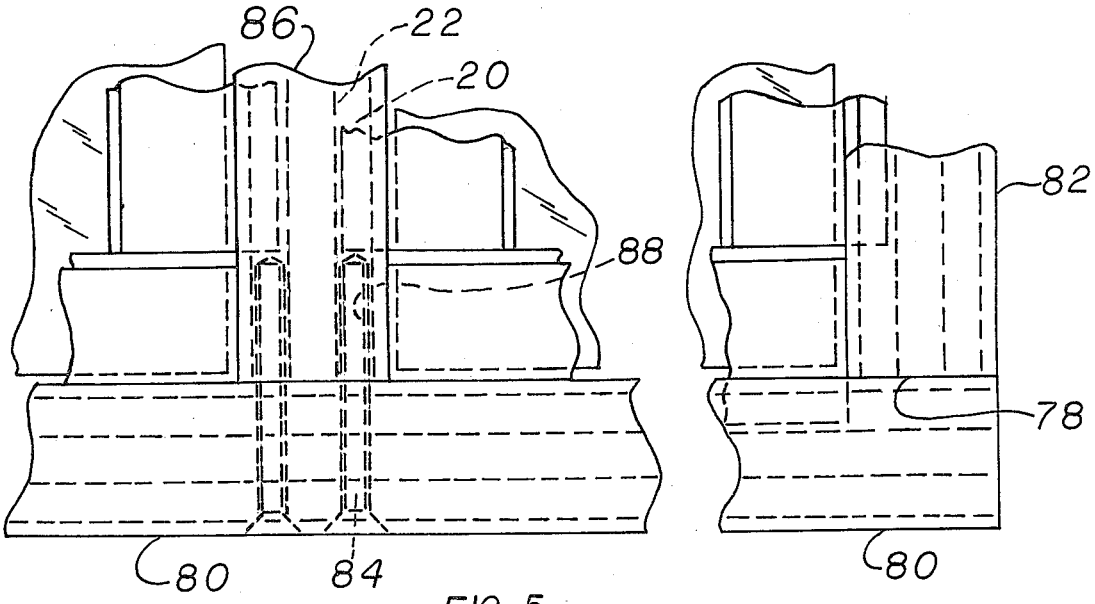

FIG. 5 illustrates means of attaching the mullions together. The simplest means of attachment is by a suitable polyolefin adhesive at the joint 78 between two perpendicular mullions 80 and 82. A second means of joining the mullions is by heating a stainless steel blade or knife placed between the mullions at 78 and then withdrawing the blade and pressing the mullions together. A third method of joining the mullions is with mechanical fasteners such as the self tapping screws 84 shown in FIG. 5. The bulbous bottoms 22 of the channels 20 formed in the mullion 86 provide a socket 88 for suitably sized screws 84.

The extruded glass stops 28 and 72 are retained by the engagement of the bulbous ends 36 in the bulbous sockets 22. To compress the flexible portion 50 or 74 against the glazing, the glass stop also engages the mullion with a longitudinal surface or edge 90 spaced from the bulbous end 36 and opposite the flexible portion.

From the above description it is quite apparent that window framing constructed and assembled from the components disclosed above are very economical to manufacture and very economical to install in manufactured housing or in field installations for residential, commercial and industrial structures. The framing is very suitable for economic retrofitting of existing structures where the existing glazing is being replaced with tinted reflective glazing.

The modified polyolefin plastics can be extruded in any color desired by the architect or owner for permanent novel window treatments that do not need to be repainted periodically. The mullions can be co-extruded with a plurality of colors by co-extruding a plurality of rigid modified polyolefin resins differing only in the color added to the resin extruded through each portion of the extrusion die. Thus, one piece plastic mullions having differing integral colors on the inside and outside of the glazing can be extruded economically.

I claim:

1. Weather and ultraviolet resistant plastic window framing comprising at least one extruded mullion of relatively rigid plastic and at least one separate extruded hollow circumferentially enclosed in cross-section glass stop substantially of relatively rigid plastic, said glass stop having means to engage said mullion and flexible sealing means adapted to engage glazing, said flexible sealing means extending outwardly from the hollow circumferentially enclosed cross-section of the glass stop, and said flexible sealing means being co-extruded with the relatively rigid glasstop plastic to form an integral one piece glass stop, wherein the mullion includes a plurality of longitudinal slots formed in the wall thereof and the glass stop means to engage the mullion nearest the glazing comprises longitudinal protrusion complementary to the mullion slots and extending outwardly from the hollow circumferentially enclosed cross-section of the glass stop, said glass stop including a longitudinal surface outwardly extended from the hollow circumferentially enclosed cross-section of the glass stop, spaced from said protrusion opposite and perpendicular to said sealing means, and engageable with the surface of the mullion, and, wherein said longitudinal surface acts as a fulcrum to cause slight rotation of said glass stop thereabout as the longitudinal protrusion is snapped into the mullion slot, the slight rotation about said longitudinal surface engagement thereby forcing said sealing means against said glazing.

2. The window framing of claim 1 wherein said slots are enlarged at the base thereof and the complementary protrusions are enlarged at the edge thereof.

3. The window framing of claim 1 wherein said slots are located on both sides of said mullion.

4. The window framing of claims 1 or 3 including at least one separate extruded nailing fin, said nailing fin including a longitudinal protrusion complementary to said mullion slots.

5. The window framing of claims 1 or 3 including at least one separate extruded plastic expansion strip comprising a rigid portion having a longitudinal protrusion extending therefrom and complementary to said mullion slots and a flexible plastic portion co-extruded with said rigid portion to form an integral structure therewith.

6. The window framing of claim 1 wherein said mullion is symmetric about central longitudinal planes parallel to the sides and edges of said mullions.

7. Weather and ultraviolet resistant plastic window framing comprising at least one extruded mullion of rigid plastic and at least one separate extruded glass stop of rigid plastic, said glass stop having means to engage said mullion and flexible sealing means adapted to engage glazing, and said flexible sealing means being co-extruded with the relatively rigid glass stop plastic to form an integral one piece glass stop, wherein the mullion includes a plurality of longitudinal slots formed in the wall thereof and the glas stop means to engage the mullion comprises a longitudinal protrusion complementary to the mullion slots, said glass stop including a longitudinal surface spaced from said protrusion opposite said sealing means and engageable with the surface of the mullion, wherein said glass stop comprises a hollow rectangular extrusion formed of two first parallel planar sides, the planar side nearest the glazing extending into the mullion slot and the other first planar side terminating with said longitudinal surface, and, two second parallel planar sides perpendicular to the first planar sides and joining the first planar sides together to form the hollow rectangular extrusion, the second planar side furthermost from said mullion extending beyond the first planar side nearest the glazing and terminating with said co-extruded flexible longitudinal sealing means, and, wherein said longitudinal surface acts as a fulcrum to cause slight rotation of said glass stop thereabout as the longitudinal protrusion is snapped into the mullion slot, the slight rotation about said longitudinal surface thereby forcing said sealing means against said glazing.

8. Plastic window framing comprising at least one extruded mullion of rigid plastic and at least one hollow circumferentially enclosed in cross-section separate extruded glass stop of rigid plastic, said glass stop including dual parallel spaced apart longitudinal means for engaging said mullion, the longitudinal means for engaging said mullion nearest the glazing comprising a protrusion extending outwardly from the hollow circumferentially enclosed cross-section of the glass stop and said mullion having recessed multiple complementary longitudinal means for engaging the protrusion, the longitudinal means for engaging said mullion furtherest from the glazing terminating with a fulcrum surface adapted to engage the mullion, and, longitudinal sealing means on said glass stop, said sealing means being spaced from said mullion and comprising a longitudinal outward extension from the hollow circumferentially enclosed cross-section of the glass stop, said sealing means extension being generally perpendicular to said protrusion and the glazing, said dual engagement means on said glass stop upon full engagement with said mullion in a direction substantially perpendicular thereto causing said glass stop sealing means to be moved substantially parallel to said mullion into tight sealing engagement with glazing inserted thereadjacent.

9. The window framing of claim 8 wherein the mullion complementary longitudinal engagement means comprise a plurality of longitudinal slots formed in the wall of the mullion, said slots being enlarged at the base thereof, wherein said glass stop longitudinal engagement means next adjacent the glazing include complementary protrusion enlarged so as to snap into the longitudinal slots in the mullions, and, wherein the other spaced apart longitudinal engagement means on the glass stop comprises a longitudinal engagement surface integrally extending from the glass stop.

10. The window framing system of claim 8 wherein said mullion is symmetric about central longitudinal planes parallel to the sides and edges of said millions and wherein identical glass stops can be attached to the mullion on both sides of the glazing to one side of the mullion as well as to the other side of the mullion.

* * * * *